United States Patent [19]

Nielsen

[11] Patent Number: 4,858,875

[45] Date of Patent: Aug. 22, 1989

[54] CORNER HOLDERS FOR MIRRORS OR SIMILAR ELEMENTS

[75] Inventor: Poul E. Nielsen, Höjbjerg, Denmark

[73] Assignee: Mogens Daugaard, Brabrand, Denmark

[21] Appl. No.: 193,689

[22] Filed: May 13, 1988

Related U.S. Application Data

[63] Continuation of Ser. No. 816,104, Dec. 12, 1985, abandoned.

[30] Foreign Application Priority Data

Apr. 16, 1984 [DK] Denmark ..... 1233/84

[51] Int. Cl.[4] ..... A47F 7/14

[52] U.S. Cl. ..... 248/488; 248/201; 248/909

[58] Field of Search ..... 248/488, 475.1, 466, 248/490, 477, DIG. 9, 548, 549, 201

[56] References Cited

U.S. PATENT DOCUMENTS

| | | | |
|---|---|---|---|
| 887,272 | 5/1908 | Robinson | 248/488 |
| 1,407,177 | 2/1922 | Stone | 248/490 X |
| 1,921,752 | 8/1933 | Hess | 248/488 X |
| 2,532,162 | 11/1950 | Goss | 248/488 X |
| 3,049,323 | 8/1962 | Peterka | 248/466 |
| 3,452,959 | 7/1969 | Ishikawa | 248/488 |
| 3,638,900 | 2/1972 | Hard | 248/488 |
| 4,497,125 | 2/1985 | Hutchinson | 248/488 X |
| 4,673,152 | 6/1987 | Brown | 248/488 X |

FOREIGN PATENT DOCUMENTS 927499 10/1947 France ..... 248/466

*Primary Examiner*—Ramon S. Britts
*Assistant Examiner*—Karen J. Chotkowski
*Attorney, Agent, or Firm*—Antonelli, Terry & Wands

[57] ABSTRACT

A corner holding for mirrors and similar elements includes a base element and a plurality of holding members, with the base element being adapted, by breaking along the weakening lines formed by a cross-shaped recess, to be divided into four sections, and with a shape corresponding to the shape of the holding members being provided with locking pins for the introduction into locking holes of the base element of the sections which are furthermore provided with fixing holes. The base element includes a circular plastic plate adapted for division into four sections defined by the cross-shaped recess, while the holding member includes an outwardly open pocket adapted for reception of a mirror corner so that a mirror by way of four holding members can be fixed to base elements secured to a wall surface. With the holder, a considerable simplification is realized by the mounting of a given mirrors wall since the number of base elements and holding member always corresponds to the number of mirrors. The mounting of the mirrors, for example, requires the use of a base element divided into four sections together with four holding members, while the mounting of four mirrors for a mirror wall requires the use of one entire base element, four half base elements, and four quarter base elements, that is, in total, four entire base elements and sixteen holding members.

6 Claims, 1 Drawing Sheet

CORNER HOLDERS FOR MIRRORS OR SIMILAR ELEMENTS

This is a continuation of application Ser. No. 816,104 filed Dec. 12, 1985, now abandoned.

BACKGROUND OF THE INVENTION

The present invention relates to a corner holder for mirrors and similar elements with the corner holder including a base element for fixing to a wall surface, which base element is provided with locking means and a holding member provided with locking members for reception in the locking means of the base element and holding means for securing a corner of a mirror.

For mounting of mirrors different holders are known being adapted for securing single mirrors or more mirrors as a wall lining. By way of example a mirror holder is known being adapted to secure one or more mirrors, the holder comprising a base element for mounting on the support, e.g. a wall surface, together with a proper holding element being adapted to be secured to the base element by means of holding pins which are pressed into holes provided in the base element. By known mirror holder the base element consists of a circular plate having projecting ribs with shape as a cross, the ribs besides being adapted to constitute a distance element between more mirrors, which are mounted as a mirror wall. In the projecting ribs locking holes are provided for corresponding locking pins on a likewise circular, button like holding element being adapted to be pressed into the base element and secure corner parts of the mirror between the base element and the holding member, the base element in advance being secured to the support e.g. by screws, glue, or in another suitable manner. The known mirror holder in question is well suited for securing adjoining mirror corners, however the mirror holder does not satisfactorily solve the securing problem about the outer edges of a mirror wall, because as well the base element as the holding member project considerably from the outer edges of the mirror wall.

The aim underlying the present invention essentially resides in providing a simplified corner holder for mirrors of the above mentioned type for enabling a reduced cost for mounting more mirrors to a mirror wall.

In accordance with the present invention the base element is divided into sections by recesses extending through a major part of the material thickness of the base element, so that the base element can be divided into a number of base element members. The corner holder comprises a number of holding members which in shape and plurality correspond to the sections or base element members of the base element. By this arrangement a very considerable simplification and price is realized for the mounting of mirror walls. Furthermore, that a mirror wall can be mounted without noticeable portions of the holder projecting outside the edge parts of the mirror wall, so the edge parts of the mirror wall can fit tightly to the other walls or building parts such as door frames and cupboards. Additionally the number of necessary corner holder members to a given mirror wall can be reduced.

The corner holder according to the invention can expediently be constituted by a circular plastic sheet material which by a cross-shaped recess is adapted to be divided into four uniform sections, each having two equal length sections disposed perpendicular to each other and an arched side edge corresponding to a quarter of a circle. Each of the holding members are provided with a shape adapted to each of the sections of the base element. So as to simplify the production thereof since, as a single, sectionalized base element and a single holding member only are to be made in suitable series to solve any mounting problem when mounting of mirror walls of quadrangle mirrors is in the question.

Each of the holding members is against the arched side edge provided with an open, pocket-like holder for a right-angled mirror corner, the height of the holder pocket being adapted to a given mirror thickness. Hereby is obtained a considerable simplification by the mounting of mirrors and mirror walls, as the holding member may simply be placed on the mirror corner, before the mirror being secured at its proper place by connection of the holding members to the prior mounted base elements.

Each of the sections of the base element is expediently provided with two locking holes and with at least one fixing hole with each of the holding members being provided with two locking pins which in size and placing are adapted to the locking holes of the base elements. Hereby is obtained a quick and safe securing of the holding members to the prior mounted base elements. Of course it is also possible to provide the base elements with locking pins and the holding elements with locking holes, but in consideration of the appearance it will be preferable to have the locking holes in the base element, because it is much easier to produce locking holes as through going holes, which would be visible if they were made in the holding member.

BRIEF DESCRIPTION OF THE DRAWINGS

The invention is further described in the following, reference being made to the accompanying drawing wherein:

FIG. 1 is a perspective view of an embodiment of a corner holder according to the invention, while

DETAILED DESCRIPTION OF THE INVENTION

Figure 1:
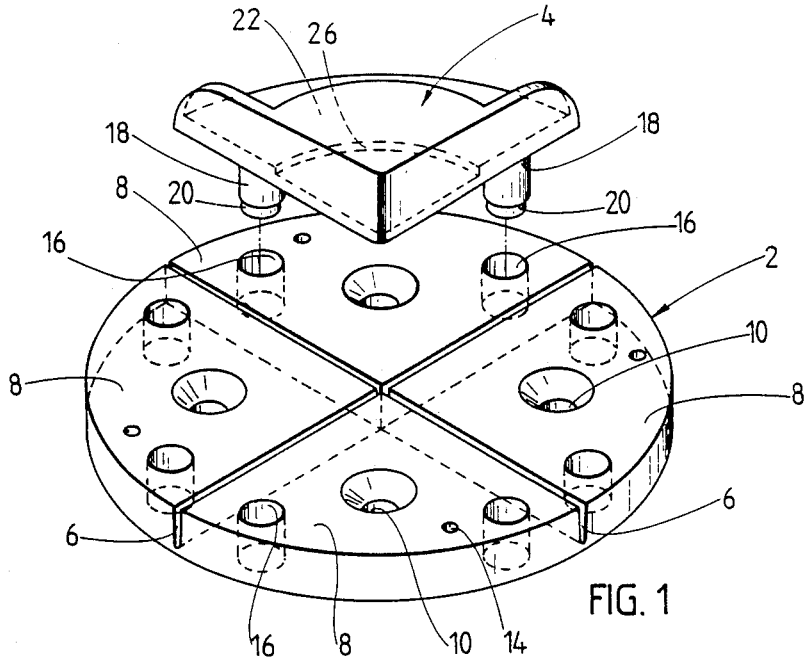
Figure 2:
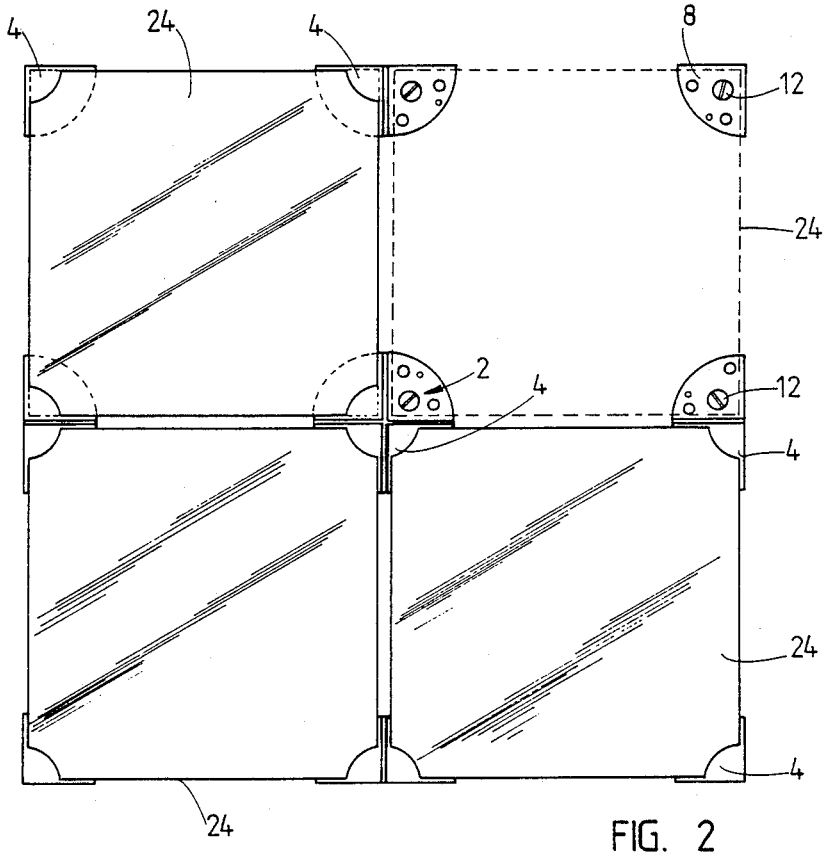
FIG. 2 is a plan view of a mirror wall during mounting with the corner holders according to the invention.

Referring now to the drawings when like reference numerals are used throughout the various views to designate like parts and, in particularly, to FIG. 1 according to this figure, a corner holder includes a base element 2 and a plurality of holding members 4, only one of which being shown. The base element 2 if fashioned of a circular plastic plate which by way of a regular cross-shaped recess 6 is divided into four uniform sections 8 adapted to be broken through breaking of the remaining material at the bottom of the recess 6, so that the base element 2 may be divided into two half base elements or into four quarter base elements (FIG. 2). Each of the sections 8 of the base element 2 is provided with a fixing hole 10 for a screw 12 (FIG. 2), a little hole 14 for a nail or a steel pin for securing especially quarter sections 8 against rotation after mounting, as the quarter sections only have one fixing hole 10 for the screw 12. Furthermore, each of the sections 8 is provided with two locking holes 16 adapted for receiving and securing the corresponding locking pins 18 of the holding member 4. To each entire base element 2 belong four holding members 4, each of which being shape-wisely adapted to the sections 8. To facilitate the introduction of the locking pin 18 of the holding member 4 into the locking holes 16 of the base element 2, the locking pins 18 are at their outer ends 20 made a little thinner over a short distance.

As mentioned the holding member 4 has the same outer shape as each of the sections 8 of the base element 2, and besides the holding member 4 is, at an upper side thereof provided with an outwardly (against the arched side edge) open pocket 22 for receiving a right-angled corner of a mirror 24 (FIG. 2). The height of the pocket 22 is adapted to a certain mirror thickness. For particularly cast-technical reasons the holding member 4 is provided with an opening 26, so that the corner of the mirror 35 can be seen from the rear side of the holding member 4.

The corner holder according to the invention is as shown in FIG. 2, used for mounting of a mirror lining of a wall. The example shown in FIG. 2 comprises four mirrors 24, which consist, in total, of four entire base elements 2 and sixteen holding members 4, employing one entire base element 2 mounted in the middle of the mirror wall, four half base elements 2 each consisting of two sections 8 and four quarter base elements 2 each consisting of one section 8. In this way the necessary number of entire base elements will always correspond to the number of mirrors 24, and to each mirror 24 are naturally employed four holding members 4. This implies an evident advantage by ordering respectively packing of the necessary parts for mounting a given mirror wall, as also the number of necessary screws corresponds to the number of holding members 4. It will, however, not be necessary to use four screws 12 for mounting of the central entire base element 2. This ca be sufficiently secured by two diagonally positioned screws 12, the base element 2 being produced of a rather hard plastic material, i.e. with sufficient strength also opposite to the recess 6, if the base element 2 has not been exposed to breaking attempts, so that the thin material areas at the recess 6 have been softened.

In order to facilitate correct mounting of the base elements 2 whether these are whole, half, or quarter a jig of paper or cardboard can advantageously be used, on which the correct mounting of the fixing holes 10 are marked. Such a jig might have exactly the same size as the mirror 24, and it might consist of the intermediary cardboard which after all normally is used by packing of more mirrors.

When all the base elements 2, whether whole, half, or quarter base elements 2 are concerned, are correctly mounted on the wall surface the easiest way for the mirror mounting is to start from below. By way of example two lower holding members 4 guided in the base elements 2 are being secured, whereafter a mirror 24 is placed in the pockets 22 and two upper holding members 4 are placed at the upper corners of the mirror 24, prior to the fixation into vertical position during simultaneous introduction of the locking pin 18 of the upper holding members 4 into the locking holes 16 of the corresponding base elements 2 or base element sections 8.

Primarily the corner holder according to the invention is adapted for mounting of mirrors, but the corner holder can of course advantageously be used for mounting of other plate-shape elements, e.g. glass plates for posters, i.e. with a function as a change frame as the holding members 4 may again be released from the base element 2—by introduction of a knife from the side and pressing out the holding member 4 from the base element. Normally the locking holes 16 and the locking pins are cylindrical, but can of course be provided with actual locking means, so that reseparation of the holding members 4 and the base element 2 cannot take place.

What is claimed is:

1. A corner holder of a planar element such as a mirror or similar element, the corner holder comprising a base element for fixation to a wall surface, said base element is provided with locking means, and a holding member provided with locking members for reception in the locking means of the base element and holding means for securing a corner of the planar element, characterized in that the base element is provided with a plurality of spaced mounting hole means and is divided into sections by recess means provided in the base element, so that the base element can be divided into one of a number of base element pieces or sections, the corner holder further comprises a plurality of holding members, which in shape and number correspond to the sections or base element pieces of the base element, said locking members are arranged on said holding members so as to enable said locking members to be received in the locking means of the base element by an insertion movement substantially perpendicular to a plane of the wall surface, and in that said mounting hole means are disposed so as to be covered by the planar element upon a mounting thereof.

2. A corner holder for mirrors or similar elements, the corner holder comprising a base element for fixation to a wall surface, said base element is provided with locking means and a holding member provided with locking members for reception in the locking means of the base element and holding means for securing a corner of the mirrors, characterized in that the base element is provided with a plurality of spaced mounting hole means and is divided into sections by recess means provided in the base element, so that the base element can be divided into one of a number of base element pieces or sections, the base element includes a circular plastic plate, said recess means is a cross-shaped recess dividing the base element into four uniform sections, each of said uniform sections including two equally long side edges perpendicular to each other and an arched side edge corresponding to a quarter of a circle, the corner holder further comprises a plurality of holding members, which in shape and number correspond to the sections of the base element, and in that each of the holding members is provided with a shape adapted to each of the uniform sections of the base element.

3. A corner holder according to claim 2, characterized in that each of the holding members is provided on the arched side edge with an open pocket for a right-angled mirror corner, a height of the open pocket being adapted to a given mirror thickness.

4. A corner holder according to claim 2, characterized in that said locking means includes locking holes, each of the uniform sections of the base element is provided with two of said locking holes and with at least one fixing hole, and in that said locking members are formed as locking pins with each of the holding members including two of said locking pins which in size and placing are adapted to the locking holes of the base element.

5. A corner holder for a mirror or similar element, the corner holder comprising a base element for fixation to a wall surface, said base element is provided with locking means, and a holding member provided with locking members for reception in the locking means of the base element and holding means for securing a corner of the mirror, characterized in that the base element is provided with a plurality of spaced mounting hole means and is divided into sections by recess means in the base element, so that the base element can be divided into one of a number of base element pieces or sections, the corner holder further comprises a plurality of holding members, which in shape and number correspond to the sections or base element pieces of the base element, said locking members are arranged on said holding members so as to enable said locking members to be received in the locking means of the base element by an insertion movement substantially perpendicular to a plane of the wall surface, and in that each of the holding members is provided on an arched side edge with an open pocket for accommodating a right-angled mirror corner, a height of the open pocket being adapted to a given mirror thickness.

6. A corner holder for a mirror or a similar element, the corner holder comprising a base element for fixation to a wall surface, said base element is provided with locking means and a holding member provided with locking members for reception in the locking means of the base element and holding means for securing a corner of the mirrors, characterized in that the base element is divided into sections by recess means provided in the base element, so that the base element can be divided into one of a number of base element pieces or sections, the corner holder further comprises a plurality of holding members, which in shape and number correspond to the sections or the base element pieces of the base element, said locking means includes locking holes, each of said sections or base element pieces is provided with two of said locking holes and with at least one fixing hole, said locking members are formed as locking pins with each of the holding members including two of said locking pins which in size and placing are adapted to the locking holes of the base element, and in that said locking pins are arranged on said holding members so as to enable said locking pins to be received in the respective locking holes of the base element by an insertion movement substantially perpendicular to a plane of the wall surface.

* * * * *